US008677667B2

(12) United States Patent
Tatum

(10) Patent No.: US 8,677,667 B2
(45) Date of Patent: Mar. 25, 2014

(54) AMBIDEXTROUS THUMB SAFETY FOR A HANDGUN

(76) Inventor: David Kenneth Tatum, Davilla, TX (US)

( * ) Notice: Subject to any disclaimer, the term of this patent is extended or adjusted under 35 U.S.C. 154(b) by 130 days.

(21) Appl. No.: 13/327,911

(22) Filed: Dec. 16, 2011

(65) Prior Publication Data

US 2013/0152444 A1 Jun. 20, 2013

(51) Int. Cl.
*F41A 17/20* (2006.01)

(52) U.S. Cl.
USPC ..... 42/70.08; 89/148

(58) Field of Classification Search
USPC ..... 42/70.04, 70.05, 70.06, 70.08; 89/142, 89/148
See application file for complete search history.

(56) References Cited

U.S. PATENT DOCUMENTS

| | | | | |
|---|---|---|---|---|
| 4,414,769 | A * | 11/1983 | Mueschke | 42/70.01 |
| 8,127,481 | B2 * | 3/2012 | Rozum et al. | 42/70.08 |
| 8,333,028 | B1 * | 12/2012 | Karfiol et al. | 42/70.01 |
| 2010/0083550 | A1 * | 4/2010 | Ogershok | 42/70.06 |
| 2012/0279384 | A1 * | 11/2012 | Hochstrate et al. | 89/142 |
| 2012/0291326 | A1 * | 11/2012 | Bova | 42/70.06 |

* cited by examiner

*Primary Examiner* — Stephen M Johnson
(74) *Attorney, Agent, or Firm* — Benjamin Aaron Adler

(57) ABSTRACT

Provided herein are an ambidextrous thumb safety and apparatuses for providing the same for a handgun. The ambidextrous thumb safety and apparatuses generally comprise right and left thumb safeties pivotally mounted in opposition to a handgun frame, means for pivotally interconnecting the mounted right and left thumb safeties on the handgun frame and means for initiating pivotal movement of the right and left side plates upon application of a force thereto. Particularly, a secondary pin with a threaded end extends from the sear contact surface on the right thumb safety and is connected to the left thumb safety via a screw at a counterbored hole through the left thumb safety.

14 Claims, 11 Drawing Sheets

AMBIDEXTROUS THUMB SAFETY FOR A HANDGUN

BACKGROUND OF THE INVENTION

1. Field of the Invention

The present invention relates generally to the fields of handguns and handgun safeties. More specifically, the present invention relates to an ambidextrous thumb safety for a pistol.

2. Description of the Related Art

Ambidextrous thumb safeties for handguns, such as for a Model 1911 semiautomatic pistol, are well known and were developed for left-handed shooting for both left-handed individuals and individuals participating in certain competitive shooting events. However, to date ambidextrous safeties have utilized only a male/female slotted pin mechanism to both secure the ambidextrous safety to the handgun frame and to ensure interconnected pivoting of both the right and left safeties. Thus, the repetitive engaging and disengaging of these thumb safeties and the concomitant pivoting of the component parts causes metal fatigue. This results in a loose safety, the integrity and utility of which is dependent solely on the fatigued slotted pin mechanism.

Thus, there is a recognized need in the art for improved ambidextrous safety features for handguns that reduce metal fatigue and increase stability and security thereof. Particularly, the prior art is deficient in an ambidextrous thumb safety for semiautomatic handguns in which the left and right thumb safeties are received and retained by the gun frame and secured to each other via both a primary and a secondary means. The present invention fulfills this longstanding need and desire in the art.

SUMMARY OF THE INVENTION

The present invention is directed to an ambidextrous thumb safety for a pistol. The ambidextrous thumb safety comprises a right side plate having a threaded pin engagement point disposed therethrough and a left side plate having a pin with a threaded end disposed on an inner surface thereof, such that the threaded pin end is in alignment with the threaded pin engagement point. The ambidextrous thumb safety also comprises means for engaging the threaded pin end at the threaded pin engagement point and means for initiating pivotal movement of the right and left side plates upon application of a force thereto. The present invention is directed to a related ambidextrous thumb safety in which the right-hand side plate further comprises a pin connector disposed thereon and the left-hand side plate further comprises a pin with a slotted end disposed thereon, where the pin connector is slottable into the slotted pin end.

The present invention is further directed to an apparatus for providing an ambidextrous thumb safety for a handgun. The apparatus comprises a right thumb safety pivotally mountable to a handgun frame and a left thumb safety pivotally mountable onto the handgun frame in opposition to the right thumb safety. The apparatus also comprises means for pivotally interconnecting the mounted right and left thumb safeties.

The present invention is directed further to an ambidextrous thumb safety in combination with a handgun frame, ambidextrous thumb safety and handgun frame combination comprises the handgun frame, means for pivotally interconnecting a right thumb safety to a left thumb safety within the handgun frame and means for initiating pivotal movement of the right and left thumb safeties upon application of a force thereto.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1A:
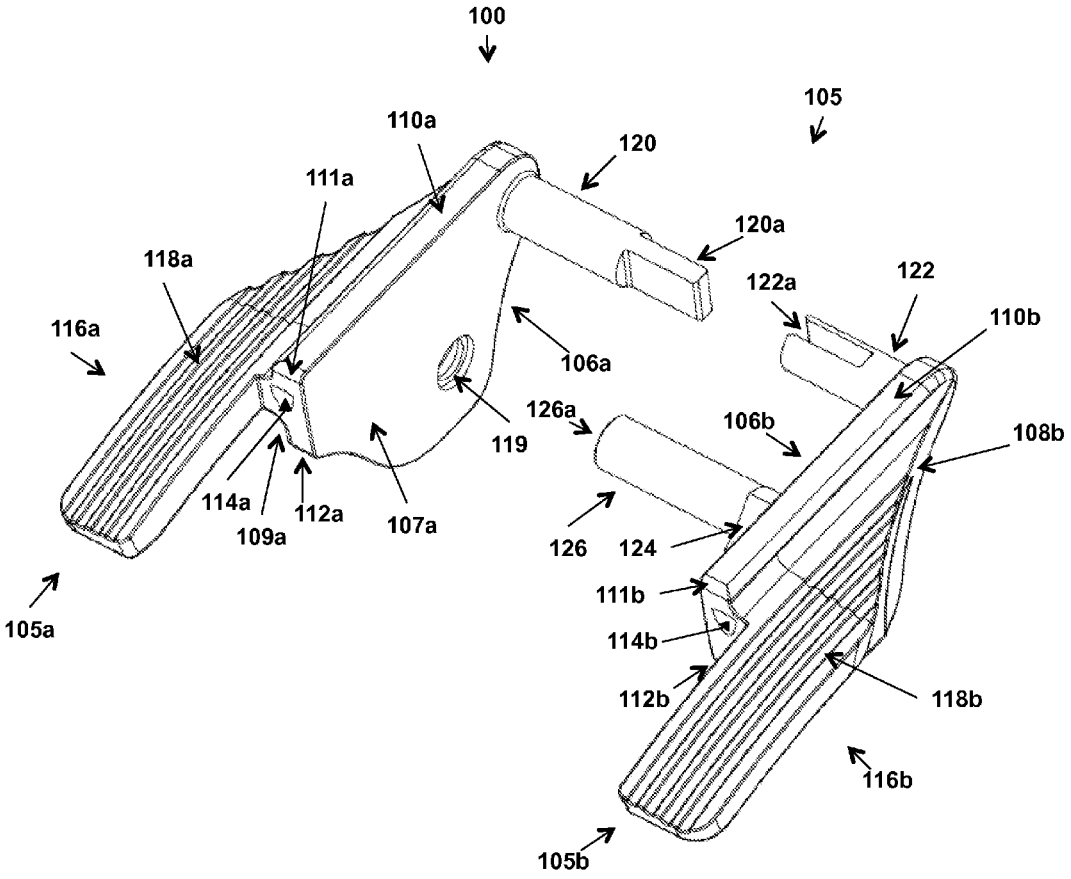
FIG. 1A is a perspective view of the exploded ambidextrous thumb safety.

As used herein the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

As used herein, the term "ambidextrous thumb safety" refers to a safety for a handgun or pistol, e.g., a Colt 1911 pistol, having two component thumb safeties interconnected through the frame of the handgun and disposed on either side thereof. That is, the right thumb safety is disposed on the right side of the gun frame and is designed to be engaged and disengaged by a left-handed person as one properly holds the handgun with the left hand. The left thumb safety is disposed on the left side of the gun frame and is designed to be engaged and disengaged by a right-handed person as one properly holds the handgun with the right hand. The term "safety" when used by itself is interchangeable with the term "ambidextrous thumb safety".

In one embodiment of the present invention, there is provided an ambidextrous thumb safety for a pistol, comprising a right side plate having a threaded pin engagement point disposed therethrough; a left side plate having a pin with a threaded end disposed on an inner surface thereof such that the threaded pin end is in alignment with the threaded pin engagement point; means for engaging the threaded pin end at the threaded pin engagement point; and means for initiating pivotal movement of the right and left side plates upon application of a force thereto. Further to this embodiment on the ambidextrous thumb safety the right-hand side plate comprises a pin connector disposed thereon and the left-hand side plate further comprises a pin with a slotted end disposed thereon where the pin connector is slottable into the slotted pin end.

In both embodiments the means for engaging the threaded pin end may be a screw. Also, in both embodiments the means for initiating pivotal movement may comprise right and left thumb pads independently disposed at an outer surface of the right and left side plates. In an aspect of this embodiment the right and left thumb pads each may have a plurality of serrations disposed on upper surfaces thereof.

In all embodiments and aspects thereof the threaded pin engagement point may be counterbored at openings thereof on the inner and an outer surfaces of the right side plate. The threaded pin may extend from a sear contact surface disposed on an inner surface of the right side plate of the right thumb safety. In a particular example, the sear contact surface may have a length of about 0.350 inches to about 0.375.

In another embodiment of the present invention there is provided an apparatus for providing an ambidextrous thumb safety for a handgun, comprising a right thumb safety pivotally mountable to a handgun frame; a left thumb safety pivotally mountable onto the handgun frame in opposition to the right thumb safety; and means for pivotally interconnecting said mounted right and left thumb safeties.

In an aspect of this embodiment the means for pivotally interconnecting the right and left thumb safeties may comprise on a side plate of the right thumb safety, a threaded pin engagement point disposed therethrough; on a side plate of the left thumb safety, a pin comprising a threaded end, where the pin is disposed thereon such that the threaded pin end is in alignment with the threaded pin engagement point through the handgun frame; and a screw threadably engaging the threaded pin end through the threaded pin engagement point. Further to this aspect the means for pivotally interconnecting the right and left thumb safeties comprises on the side plate of the right thumb safety, a pin connector; and on the side plate of the left thumb safety, a pin comprising a slotted end, said pin connector slotted into the slotted pin.

In these aspects the threaded pin engagement point may be counterbored at openings thereof on the inner and an outer surfaces of the right side plate. The threaded pin may extend from a sear contact surface disposed on an inner surface of the side plate of the right thumb safety. In a particular example the length of the sear contact surface may be as described supra. In all embodiments and aspects thereof the right and left thumb safeties may comprise right and left thumb pads independently disposed on an outer surface thereof, where the thumb pads have a plurality of serrations disposed on their upper surfaces.

In yet another embodiment of the present invention there is provided an ambidextrous thumb safety in combination with a handgun frame, comprising the handgun frame; means for pivotally interconnecting a right thumb safety to a left thumb safety within the handgun frame; and means for initiating pivotal movement of the right and left thumb safeties upon application of a force thereto.

In this embodiment the handgun frame may comprise receiving portions for the right thumb safety and the left thumb safety, where the right and left thumb safeties are pivotally interconnectable upon being received therethrough. In this embodiment the means for pivotally interconnecting a right thumb safety to a left thumb safety may comprises a threaded pin engagement point and a pin connector independently disposed on an inner surface of the right thumb safety; a sear contact surface having a pin with a threaded end extending therefrom and a pin comprising a slotted end independently disposed on an inner surface of the left thumb safety, said threaded pin end in alignment with the threaded pin engagement point and said pin connector slotted into the slotted pin; and a screw threadably engaging the threaded pin end through the threaded pin engagement point. In one aspect the threaded pin engagement point may be counterbored at openings thereof on the inner and an outer surfaces of the right thumb safety. In another aspect the sear contact surface may have a length as described supra. In addition in this embodiment the means for initiating pivotal movement of the right and left thumb safeties comprises right and left thumb pads independently disposed at an outer surface of the right and left thumb safeties, where the thumb pads may have a plurality of serrations disposed on upper surfaces thereof.

Provided herein are an ambidextrous thumb safety and apparatuses for ambidextrously engaging or disengaging a safety for a handgun or pistol. A combination of features, as described herein, increases structural rigidity of the safety and reduces metal fatigue therein. This represents a significant improvement over the prior art use of only the male/female slotted pin mechanism.

Firstly, a secondary pin connects the right and left component safeties via screw. This reduces leverage forces on the slotted primary pin as the ambidextrous safety is engaged and disengaged. Moreover, the screw is threaded into the threaded end of the secondary pin through a counterbored hole in the right thumb safety which enables the screw to be inset from the outer surface. This decreases both bulk on the outer right thumb safety and the likelihood that the screw will loosen as the safety is utilized. Secondly, the length of the sear contact surface is increased thereby providing a greater surface area by which to contact the sere in the handgun. Thirdly, the secondary pin is disposed on and extends from the lengthened sear contact surface. The greater surface area of the sear enables a greater diameter across the threaded end of the secondary pin thereby increasing the structural strength of the secondary pin.

As described below, the invention provides a number of advantages and uses, however such advantages and uses are not limited by such description. Embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1A is an exploded view 100 of the ambidextrous thumb safety. The ambidextrous thumb safety 105 comprises right 105*a* and left 105*b* thumb safeties. In a general overview the right or ambi-side thumb safety 105*a* comprises a right or ambi-side side plate 106*a* with a threaded pin engagement hole 119 therethrough counterbored at both the inner 107*a* and outer 108*a* (see FIG. 2B) surfaces to threadably engage a screw 130 or other threaded securing means as is known in the art (see FIGS. 4A-4B). A thumb pad 116*a* having a plurality of serrations 118*a* along the top surface is formed on the outer surface 108*a* of the side plate. A primary pin connector 120 with a blade-like connecting end 120*a* is formed on the inner surface 107*a* thereof.

The right thumb pad extends along the right side plate in the direction of the gun barrel. As is known in the art a left-handed person properly holding or handling the handgun engages the ambi-side safety by lifting up the right thumb pad with the top or side of the left hand thumb and disengages the safety by pushing down on the thumb pad with the thumb. The thumb pad serrations provide a surface configured to prevent the thumb from slipping off the thumb pad while disengaging the safety.

The right side plate has an end 109*a* with an included detent shoulder 112*a* and detent cavity 114*a* which work together to ensure the safety either is on or off precluding the safety from floating between safe and fire positions and utilizes a pin and spring mechanism as is known in the art. The right side plate is a full profile side plate and supports the left or main-side side plate 105*b*. As such, the right side plate has a relief angle cut 111*a* angled from the top end 110*a* to the front end above the detent cavity to accommodate the slide of the handgun.

The left or main-side thumb safety 105*b* comprises a left or main-side side plate 106*b* that has components mirroring the right thumb safety 105*a*. Generally, the left side plate is a full profile side plate having inner 107*b* and outer 108*b* surfaces, a thumb pad 116*b* with a plurality of serrations 118*b* along the top surface thereof formed on the outer surface of the side plate, a detent shoulder 112*b* and detent cavity 114*b* with a pin and spring mechanism and a relief angle cut 111*b* angled from the top end 110*b*. As described for the right or ambi-side thumb safety, a right-handed person engages and disengages the safety by lifting up or pressing down the left side thumb pad.

The left side plate 105*b* has a primary pin 122 with a slotted end 122*a* that is formed on the left side plate inner surface 107*b*. The primary pin connector 120 and the primary pin are in alignment when the right 105*a* and left 105*b* thumb safeties are received through the frame of the handgun. The primary pin connector end engages the slotted end of the primary pin.

The sere contact surface 124 is disposed on the inner surface of the left side plate to contact the sere when the safety is engaged to prevent an unwanted or accidental discharge. In the instant invention the sere contact surface has a length L (see FIG. 2C) which is longer than that of sear contact surfaces known and standard in the art. Length L may be about 0.350 inches to about 0.375 inches. This represents a length of about 0.150 inches to about 0.200 inches longer than the well-known and standard length of the sear contact surface. The added length of the sere contact surface results in a greater surface area to more fully engage the sear thereby providing additional security when the safety is engaged.

A secondary pin 126 is formed from the sere contact surface. The secondary pin has a female threaded end 126*a* which aligns with and is received into the counterbored threaded pin engagement hole 119 on the inner surface of the right thumb safety when the right and left thumb safeties are received through the frame of the handgun. The screw 130 or other threaded securing means threadably engages the female threaded end of the secondary pin through the counterbored hole (see FIG. 5B) to connect the right and left side plates.

The secondary pin in combination with the lengthened sere contact surface and the screw securement provides an improved reduction in metal fatigue over that provided by the primary pin connector slotted into the primary pin. The increased length L of the sere contact surface enables the secondary pin to have a corresponding increase in diameter across the threaded end thereby strengthening the secondary pin. The secondary pin reduces the leverage pressure on the primary pin, which can cause a sloppy or loose safety, and acts as a stop when the safety is engaged or disengaged. Screwing, or other means of fastening, the secondary pin to the right side plate at the female threaded end inside the counterbored hole increases the stability and, thereby, reliability of the secondary pin. In addition, since the hole is counterbored at both the inner and outer surfaces of the right side plate, the screw also is inset when threadably engaging the secondary pin which prevents the secondary pin from moving unless the ambidextrous thumb safety is moved as a whole. An inset screw also reduces bulk on the side plate.

Figure 1B:
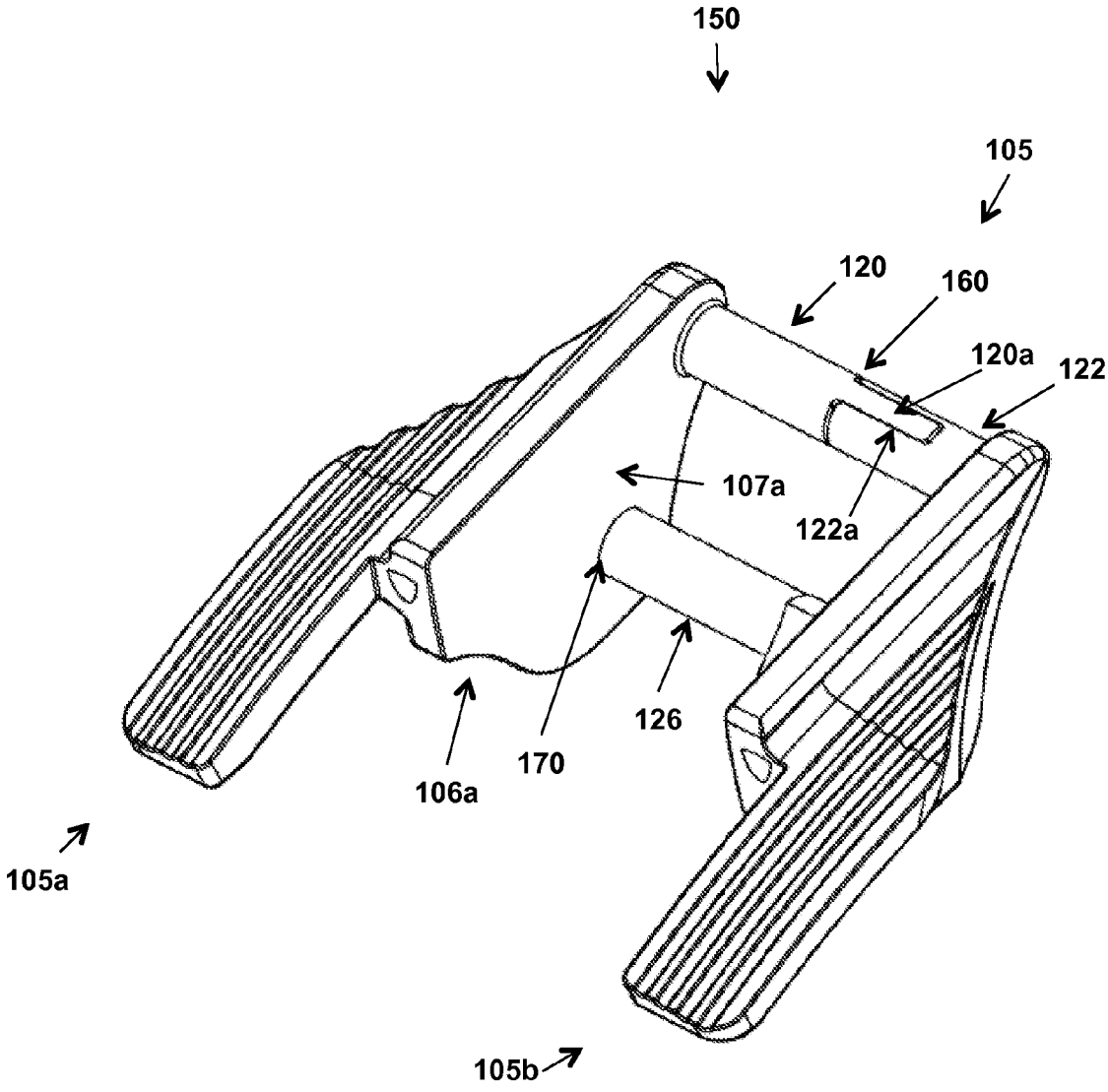
FIG. 1B is a perspective view of the assembled ambidextrous thumb safety.

With continued reference to FIG. 1A, FIG. 1B is an assembled view 150 of the ambidextrous thumb safety 105 shown in FIG. 1A. The right 105*a* and left 105*b* thumb safeties are connected at 160 and 170. At 160, the primary pin 122 receives the primary pin connector 120 into the slotted pin end 120*a*. At 170, the secondary pin 126 is threadably secured to the right side plate through the inside counterbored hole on the inner surface 107*a* of the right side plate. As connected, the right and left thumb safeties will rotate as a whole whether a person holding or handling the handgun engages or disengages either the right or left thumb safety.

Figures 2A, 2B:
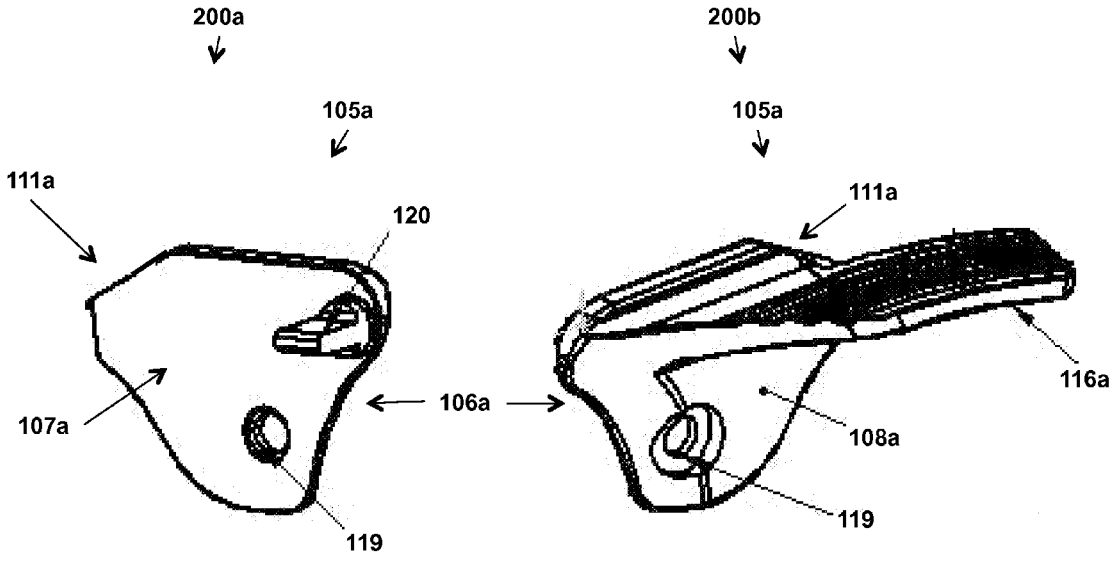
FIG. 2A is a partial side plan view of the right safety showing the inner threaded counterbored hole.
FIG. 2B is a partial side plan view of the right safety showing the outer threaded counterbored hole.

With continued reference to FIG. 1A and considered jointly, FIGS. 2A and 2B are partial side plan views 200*a* and 200*b* of the right thumb safety 105*a*. View 220*a* shows the inner surface 107*a* of the right side plate 106*a* depicting the inside counterboring of the threaded pin engagement hole 119 therethrough and the disposition of the primary pin connector 120. Particularly one is better able to view the relief angle cut 111*a* on the full profile of the right side plate. View 200*b* shows the outer surface 108*a* of the right side plate 106*a* depicting the outside counterboring of the threaded pin engagement hole 119 therethrough and the disposition of the right thumb pad 116*a* along the right side plate outer surface.

Figure 2C:
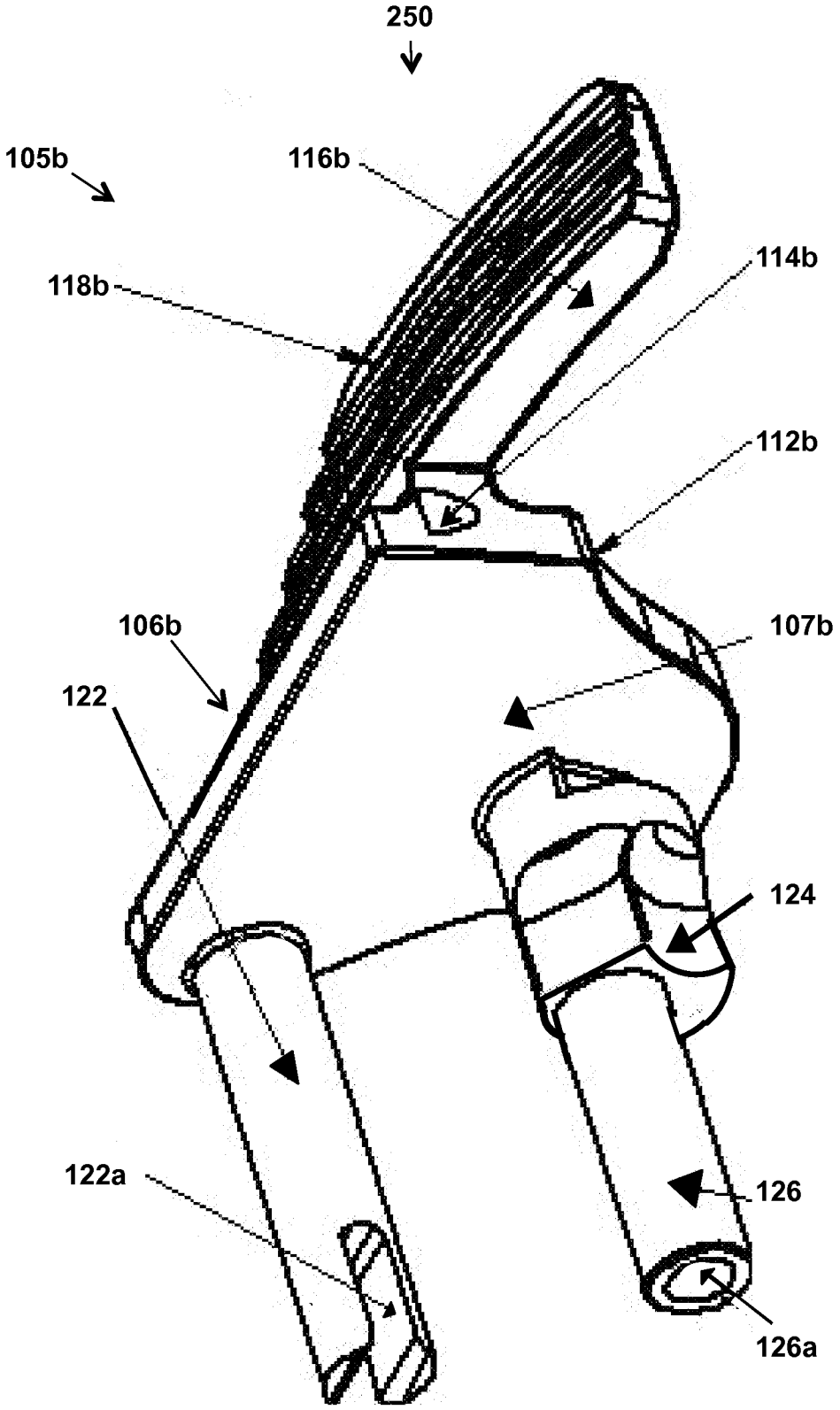
FIG. 2C is a perspective side view of the left safety.

With continued reference to FIG. 1A, FIG. 2C is side plan view 250 of the left thumb safety 105*b*. View 250 shows the inner surface 107*b* of the left side plate 106*b* from a perspective that distinctly enables one to view the disposition of the primary pin 122, the sere contact surface 124 and secondary pin 126, the detent shoulder 112*b* and detent cavity 114*b* and serrations 118*b* on thumbpad 116*b*. Moreover, the plan view 250 enables one to better view the slotted end 122*a* of the primary pin and to view the female threaded end 126*a* of the secondary pin. The sere engagement surface with a length L extends farther along the secondary pin, which better supports and strengthens the secondary pin, as described herein.

Figure 3A:
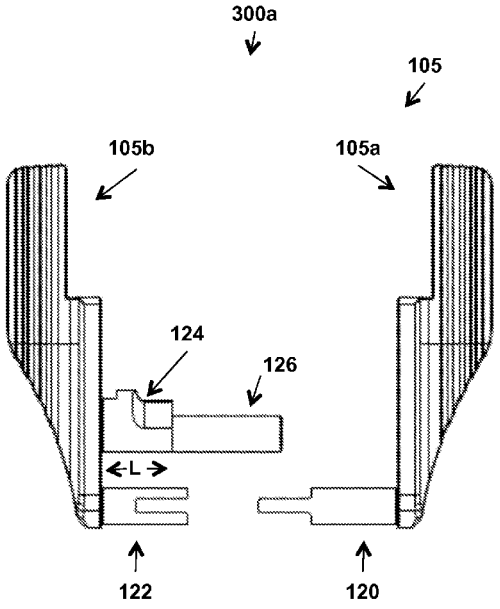
FIGS. 3A-3B are top plan views of the exploded and assembled ambidextrous thumb safety.
Figure 3B:
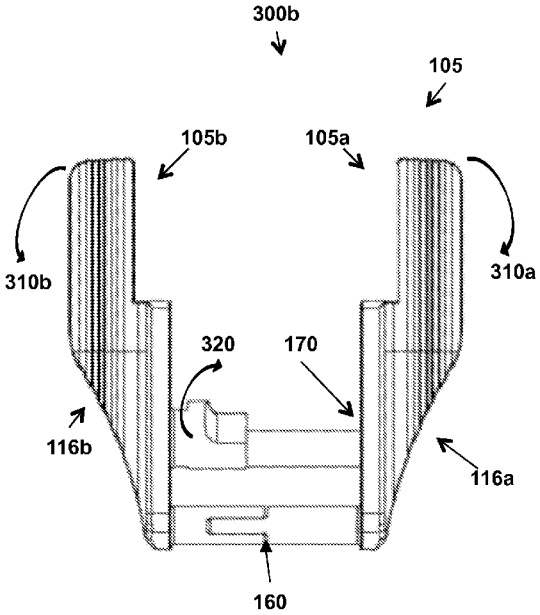

With continued reference to FIGS. 1A and 1B and considered jointly, FIGS. 3A and 3B are exploded and assembled top plan views 300*a* and 300*b* of the ambidextrous thumb safety 105. Views 300*a* and 300*b* provide alternate views of the disposition and arrangement of the primary pin connector 120 and primary pin 122 in relation to each other on their respective right 105*a* and left 105*b* thumb safeties and as interconnected 160, 170 to each other when received through a handgun frame. Particularly, the sere contact surface 124 in relation to the secondary pin 126 is depicted. The view 300*b* enables one to visualize how depressing at 310*a* or 310*b* one of the thumb pads 116*a*, 116*b* would disengage the safety by rotating the sere contact surface away at 320 from a person holding the handgun.

Figure 3C:
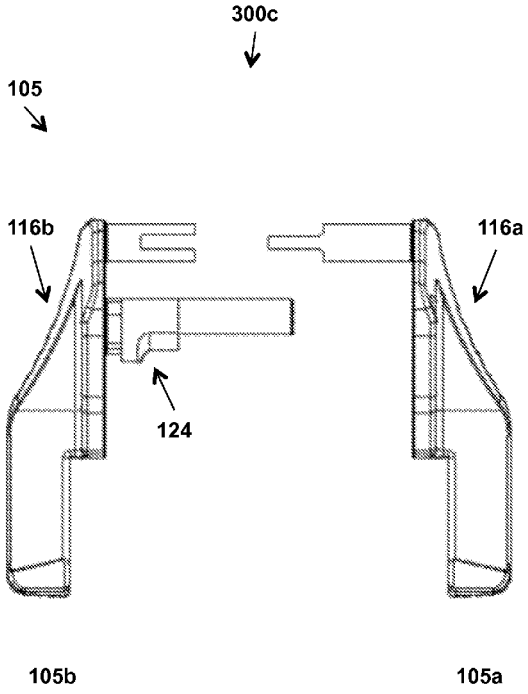
FIGS. 3C-3D are bottom plan views of the exploded and assembled ambidextrous thumb safety.
Figure 3D:
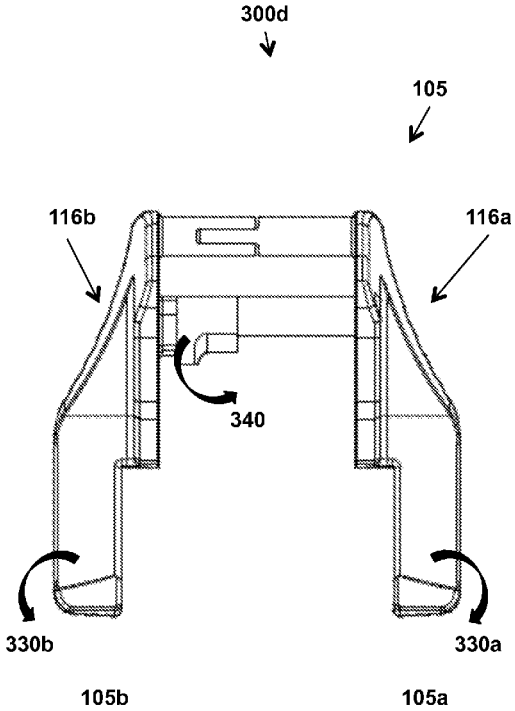

With continued reference to FIGS. 3A and 3B and considered jointly, FIGS. 3C and 3D are exploded and assembled bottom plan views 300*c* and 300*d* of the ambidextrous thumb safety 105. Views 300*c* and 300*d* depict the bottom or underside of the of right 105*a* and left 105*b* thumb safeties with their respective components shown in views 300*a* and 300*b*. As described herein, one holding the handgun would engage the safety by contacting the bottom surface of one of the thumb pads 116*a*, 116*b* with the top or side of the thumb and lifting at 330*a* or 330*b* the thumb pad. The sere contact surface 124 would rotate toward the sere at 340 thereby engaging the safety.

Figure 4A:
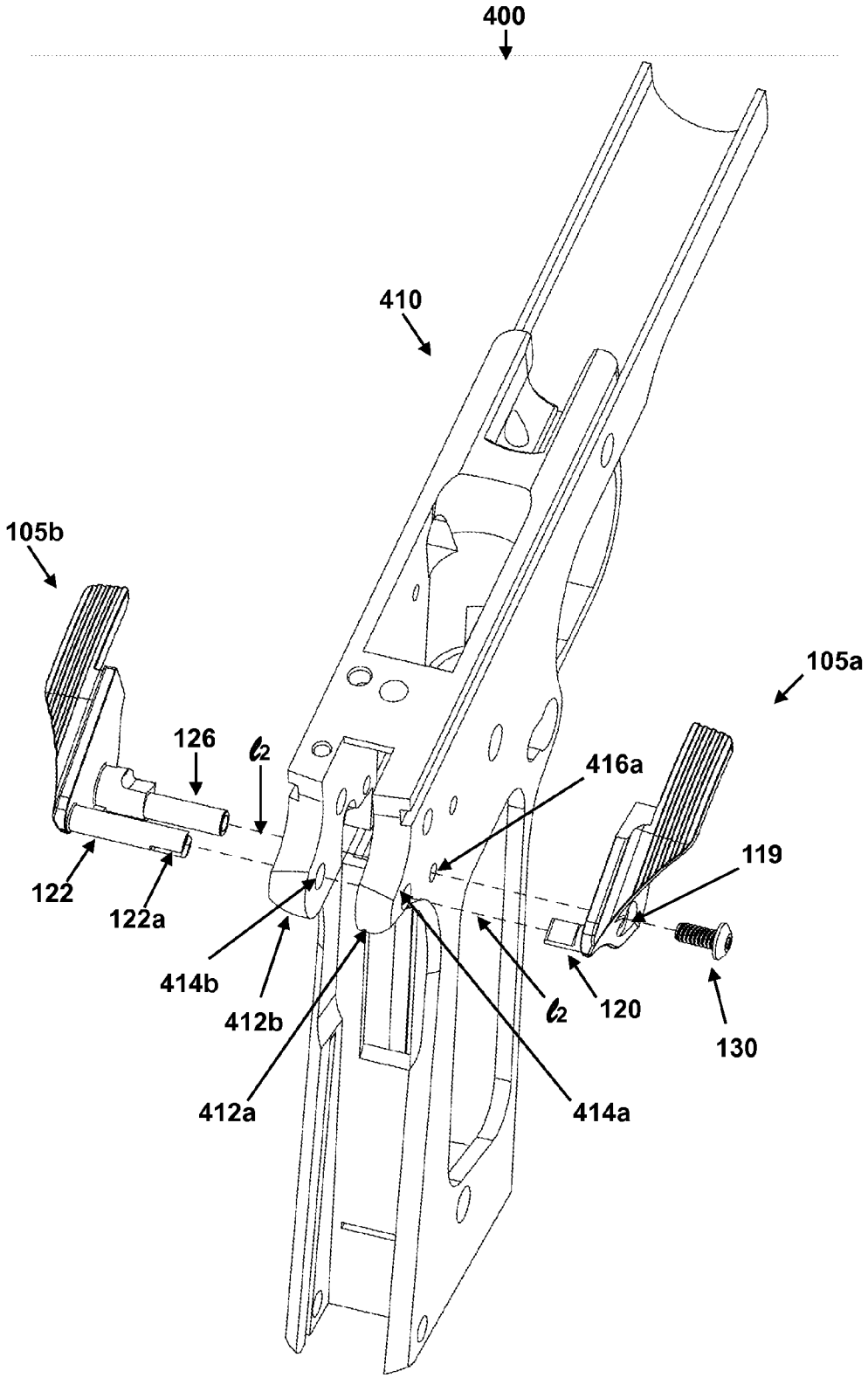
FIGS. 4A-4B are isometric views of the right and left safeties depicting incorporation with a handgun frame.

With continued reference to FIG. 3A, FIG. 4A is an isometric view 400 depicting the positional relationship and interconnection of the right 105*a* and left 105*b* thumb safeties within a handgun from a top plan perspective. A handgun frame 410 has receiving portions 412*a* and 412*b* configured to receive the right and left thumb safeties. Portions 412*a* and 412*b* comprise receiving means 414*a,b* and 416*a,b* therethrough. The view illustrates receiving means 414*a* and 416*a* on the outside surface of receiving portion 412*a* and receiving means 414*b* on the inside surface of receiving portion 412*b*. Receiving means 414*a* and 414*b* are in alignment along line l1 and receiving means 416*a* and 416*b* are in alignment along line l2. The primary pin connector 120 and the primary pin 122 are received into the handgun frame at 414*a* and 414*b* along l1 whereupon the slotted end 122*a* of the primary pin engages the primary pin connector. The inside counterbored threaded pin engagement hole 119 aligns with 416*a* along l2 and the secondary pin 126 is received into the handgun frame at 416*b* along l2. The threaded female end 126*a* of the secondary pin engages with the inside counterbored hole through 416*a* along l2. The secondary pin is secured to the handgun frame at the threaded end with screw 130 through the outside counterbored threaded pin engagement hole. Thus, the right side and left side thumb safeties are positioned on either side of the handgun frame at 412*a* and 412*b* and pivotally interconnected therethrough.

Figure 4B:
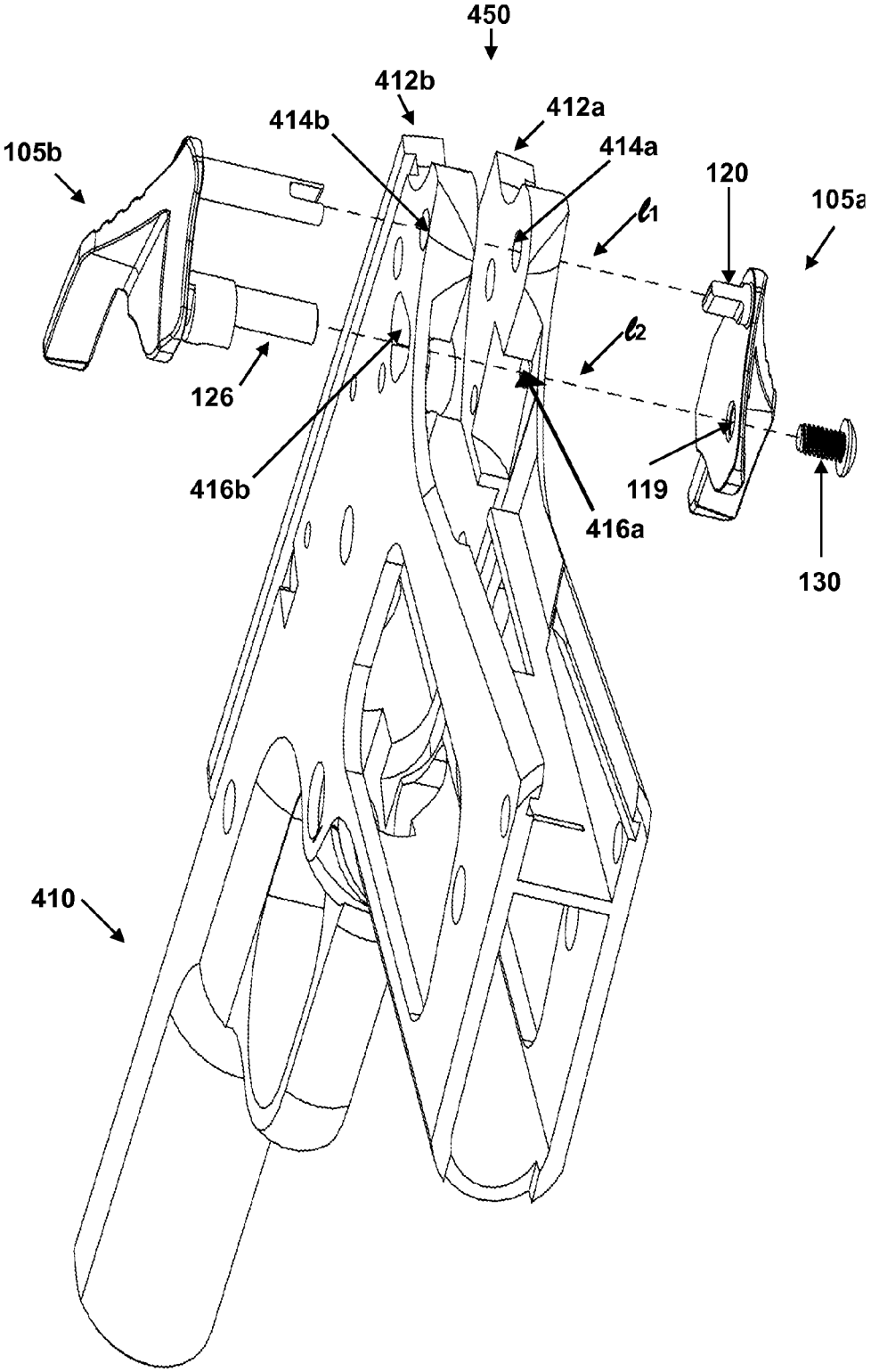

With continued reference to FIG. 3B, FIG. 4B is an isometric view 450 depicting the positional relationship and interconnection of the right 105*a* and left 105*b* thumb safeties with a handgun from a bottom plan perspective. The view illustrates receiving means 414*a* and 416*a* on the inside surface of receiving portion 412*a* and receiving means 414*b* and 416*b* on the outside surface of receiving portion 412*b* on the handgun frame 410. One is better able to visualize how the primary pin is received through 414*b* on the outside of the handgun frame and connects with the primary pin connector 120 after it is received through 414*a* along l1. Moreover, one can better view the alignment of the inside counterbored threaded pin engagement hole 119 with receiving means 416*a* and how the secondary pin 126 engages with the inside counterbored hole through receiving means 416*b* and 416*a* to be secured with screw 130.

Figure 5A:
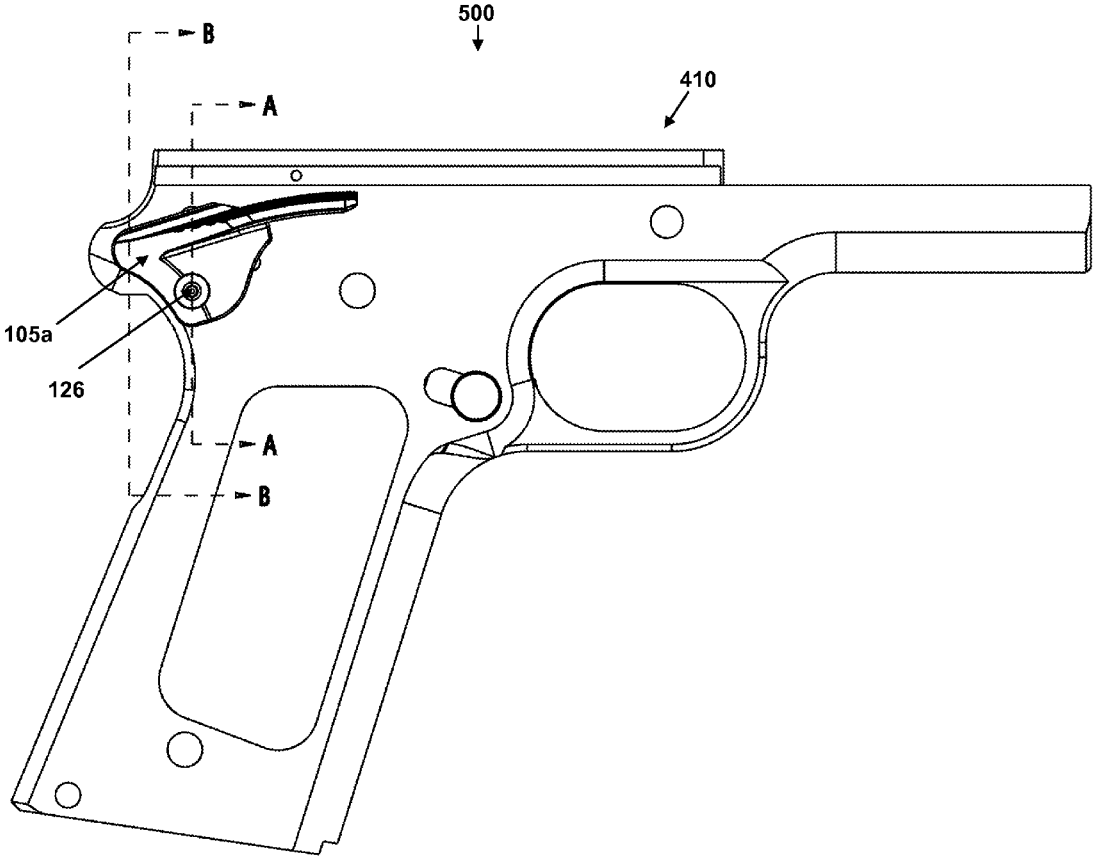
FIG. 5A is a right side plan view of a handgun frame showing the right thumb safety and depicting cross-sectional lines A-A and B-B.

With continued reference to FIGS. 4A and 4B, FIG. 5A is a right side view 500 of the handgun frame 410 showing the right thumb safety 105*a* of the ambidextrous thumb safety 105 connected thereto. Section line A-A represents a lateral cross-section across the secondary pin 126 and is further illustrated in FIG. 5B. Section line B-B represents a lateral cross-section across the primary pin 120 and is further illustrated in FIG. 5C.

Figure 5B:
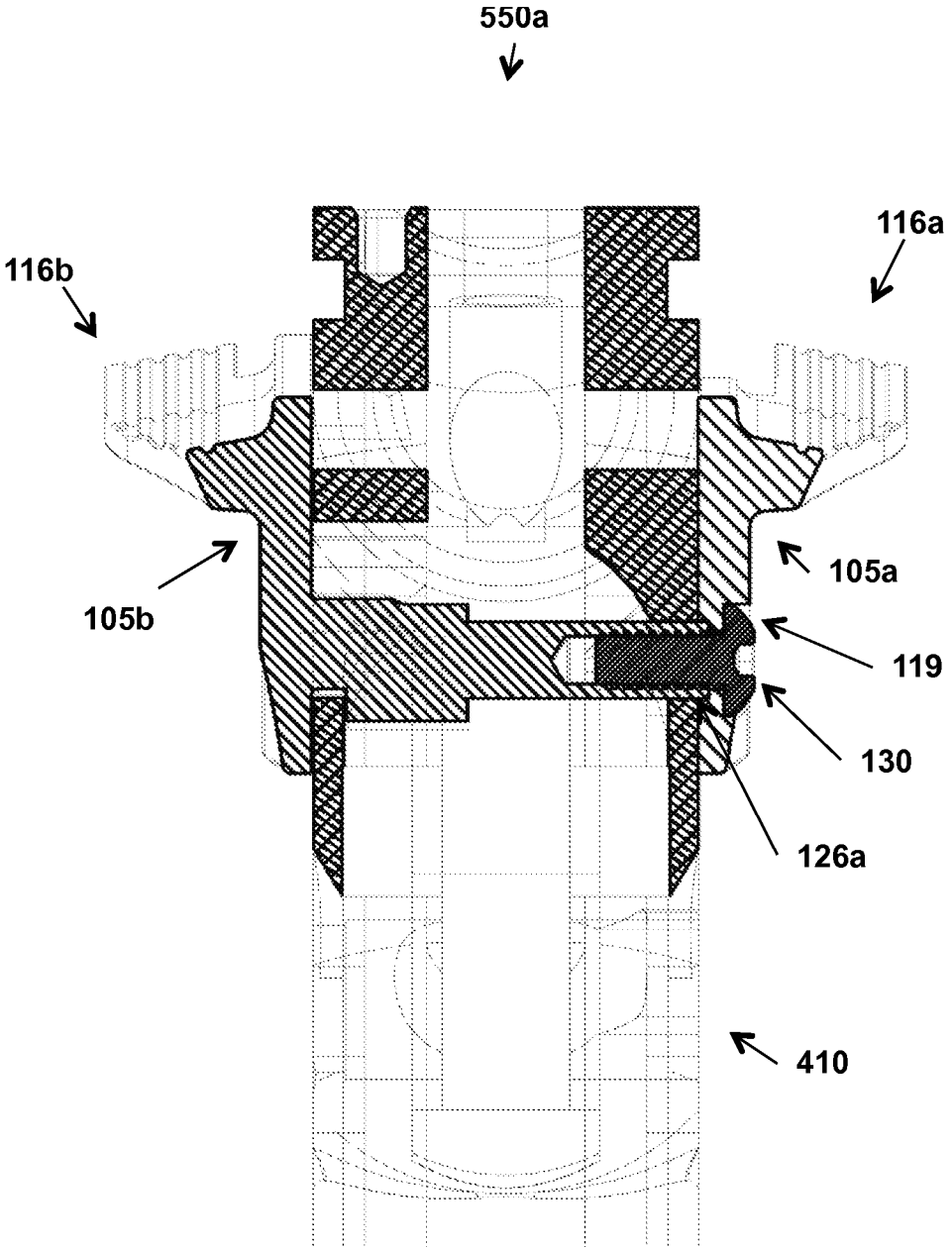
FIG. 5B is a cross-sectional view of the ambidextrous thumb safety along A-A.
Figure 5C:
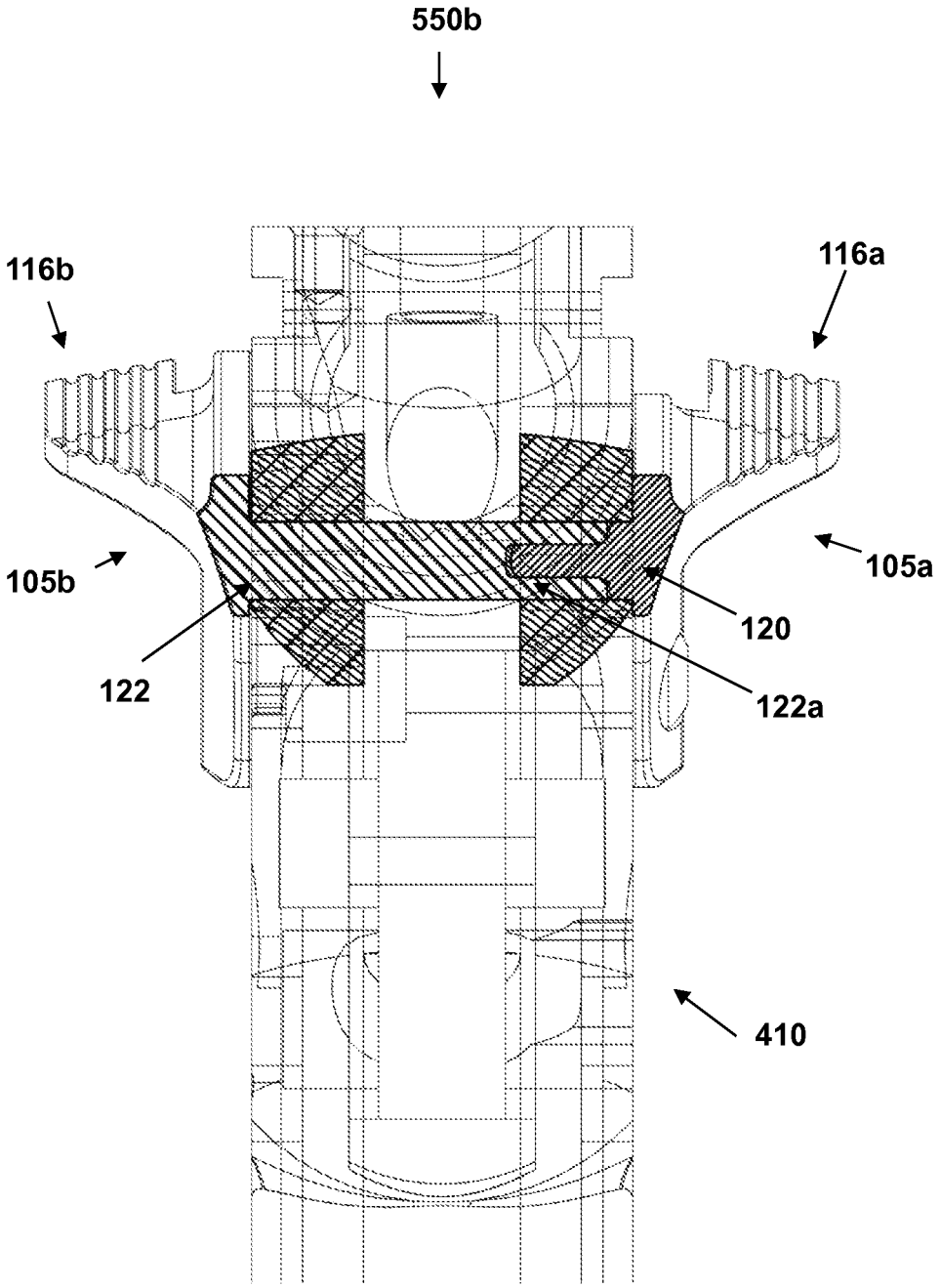
FIG. 5C is a cross-sectional view of the ambidextrous thumb safety along B-B.

With continued reference to FIG. 5A, FIGS. 5B and 5C are cross-sectional top views 550*a* and 550*b* across section lines A-A and B-B and considered jointly. View 550*a* across A-A illustrates how the screw 130 threadably engages the threaded end 126*a* of the secondary pin 126 through the counterbored threaded pin engagement hole 119 to interconnect the right thumb safety 105*a* to the left thumb safety 105*b* across the handgun frame 410. The screwhead is inset within the outside counterbore of the threaded pin engagement 119 adding stability and security to the secondary pin. View 550*b* illustrates how the slotted end 122*a* of the primary pin 122 engages the primary pin connector 120 to interconnect the right 105*a* and left 105*b* thumb safeties within the handgun frame 410. Depressing or lifting one of the right 116*a* or left 116*b* thumb pads pivots or rotates the ambidextrous thumb safety as a whole.

One skilled in the art will readily appreciate that the present invention is well adapted to carry out the objects and obtain the ends and advantages mentioned, as well as those inherent therein. It will be apparent to those skilled in the art that various modifications and variations can be made in practicing the present invention without departing from the spirit or scope of the invention. Changes therein and other uses will occur to those skilled in the art which are encompassed within the spirit of the invention as defined by the scope of the claims.

What is claimed is:

1. An ambidextrous thumb safety for a handgun, comprising:

a right side plate having a threaded pin engagement hole disposed therethrough counterbored at openings thereof on the inner and an outer surfaces of the right side plate;

a left side plate having a pin with a threaded end disposed on an inner surface thereof such that the threaded pin end is in alignment with the threaded pin engagement hole;

a screw engagable with the threaded pin end at the threaded pin engagement hole; and right and left thumb pads independently disposed at the outer surface of the right and left side plates such that the right and left side plates are pivotable upon application of a force to said thumb pads.

2. The ambidextrous thumb safety of claim 1, wherein the right-hand side plate further comprises a pin connector disposed thereon and the left-hand side plate further comprises a pin with a slotted end disposed thereon, said pin connector slottable into the slotted pin end.

3. The ambidextrous thumb safety of claim 1, wherein the threaded pin extends from a sear contact surface disposed on an inner surface of the left side plate of the left thumb safety.

4. The ambidextrous thumb safety of claim 3, wherein the sear contact surface has a length of about 0.350 inches to about 0.375 inches.

5. The ambidextrous thumb safety of claim 1, wherein the right and left thumb pads each have a plurality of serrations disposed on upper surfaces thereof.

6. An apparatus for providing an ambidextrous thumb safety for a handgun, comprising:

a right thumb safety pivotally mountable to a handgun frame;

a left thumb safety pivotally mountable onto the handgun frame in opposition to the right thumb safety;

on a side plate of the right thumb safety, a threaded pin engagement hole disposed therethrough which is counterbored at openings thereof on the inner and an outer surfaces of the right side plate;

on a side plate of the left thumb safety, a pin comprising a threaded end, said pin disposed thereon such that the threaded pin end is in alignment with the threaded pin engagement hole through the handgun frame; and a screw threadably engaging the threaded pin end through the threaded pin engagement hole.

7. The apparatus of claim 6, further comprising:

on the side plate of the right thumb safety, a pin connector; and on the side plate of the left thumb safety, a pin comprising a slotted end, said pin connector slotted into the slotted pin.

8. The apparatus of claim 6, wherein the threaded pin extends from a sear contact surface disposed on an inner surface of the side plate of the left thumb safety.

9. The apparatus of claim 8, wherein the sear contact surface has a length of about 0.350 inches to about 0.375 inches.

10. The apparatus of claim 6, wherein the right and left thumb safeties comprise right and left thumb pads independently disposed on an outer surface thereof, said thumb pads having a plurality of serrations disposed on their upper surfaces.

11. An ambidextrous thumb safety in combination with a handgun frame, comprising:

the handgun frame;

a threaded pin engagement hole and a pin connector independently disposed on an inner surface of a right thumb safety on the handgun frame; wherein the threaded pin engagement hole is counterbored at openings thereof on the inner and an outer surfaces of the right thumb safety;

a sear contact surface having a pin with a threaded end extending therefrom and a pin comprising a slotted end independently disposed on an inner surface of a left thumb safety on the handgun frame, said threaded pin end in alignment with the threaded pin engagement point and said pin connector slotted into the slotted pin;

a screw threadably engaging the threaded pin end through the threaded pin engagement hole; and right and left thumb pads independently disposed at the outer surface of the right and left thumb safeties.

12. The ambidextrous thumb safety and handgun frame combination of claim 11, wherein the handgun frame comprises receiving portions for the right thumb safety and the left thumb safety, said right and left thumb safeties pivotally interconnectable upon being received through the handgun frame.

13. The ambidextrous thumb safety and handgun frame combination of claim 11, wherein the sear contact surface has a length of about 0.350 inches to about 0.375 inches.

14. The ambidextrous thumb safety and handgun frame combination of claim 11, wherein said thumb pads have a plurality of serrations disposed on upper surfaces thereof.

* * * * *